United States Patent [19]

Fleischmann et al.

[11] Patent Number: 4,963,076

[45] Date of Patent: Oct. 16, 1990

[54] RADIAL BLOWER WITH RESILIENTLY MOUNTED BEARING HOLDERS

[75] Inventors: Frank Fleischmann, Bergheim-Glessen; Hans-Peter Kabelitz; Winfried Kaiser, both of Cologne, all of Fed. Rep. of Germany

[73] Assignee: Leybold Aktiengesellschaft, Hanau, Fed. Rep. of Germany

[21] Appl. No.: 332,867

[22] Filed: Apr. 3, 1989

[30] Foreign Application Priority Data

Apr. 27, 1988 [DE] Fed. Rep. of Germany ..... 3814130

[51] Int. Cl.[5] ..... F04D 29/04

[52] U.S. Cl. ..... 417/423.7; 417/423.12; 417/423.14; 417/423.15; 310/51

[58] Field of Search ..... 417/423.2, 423.7, 423.15, 417/423.12, 423.14; 415/214.1; 310/51

[56] References Cited

U.S. PATENT DOCUMENTS

| | | | |
|---|---|---|---|
| 2,020,092 | 7/1934 | Allen | 417/423.2 |
| 2,098,073 | 11/1937 | Tucker | 310/51 |
| 2,329,151 | 9/1943 | Brady | 171/252 |
| 2,888,193 | 5/1959 | Greenwald | 230/117 |
| 4,058,937 | 11/1977 | Mitchell | 51/259 |
| 4,198,191 | 4/1980 | Pierce | 310/63 |
| 4,456,433 | 6/1984 | Henning | 417/53 |
| 4,764,086 | 8/1988 | Jesinger | 415/112 |

FOREIGN PATENT DOCUMENTS

| | | | |
|---|---|---|---|
| 1613137 | 6/1969 | Fed. Rep. of Germany . | |
| 56-98352 | 7/1981 | Japan . | |
| 386186 | 12/1964 | Switzerland . | |
| 939508 | 10/1963 | United Kingdom | 310/51 |

*Primary Examiner*—Leonard E. Smith
*Assistant Examiner*—David W. Scheuermann
*Attorney, Agent, or Firm*—Felfe & Lynch

[57] ABSTRACT

Rotating unit including a shaft, a blower rotor, and a motor armature is removable as a unit from the motor housing. The diameter of a first resiliently mounted bearing holder toward the blower rotor is larger than the diameter of the armature, which in turn is larger than the diameter of a second resiliently mounted bearing holder remote from the blower rotor.

4 Claims, 1 Drawing Sheet

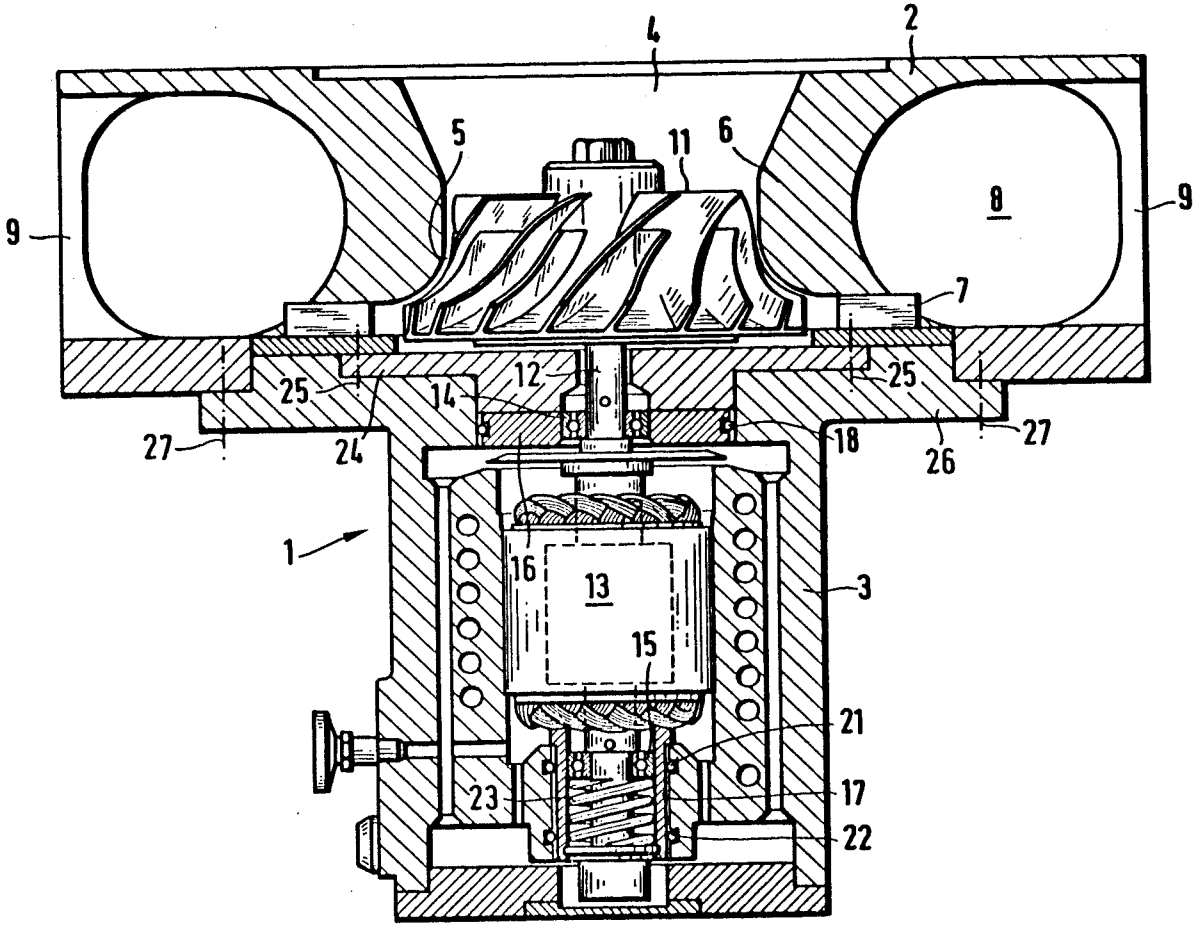
9
8
2
7
27
26
25
6
4
11
18
3
21
17
22
15
13
12
16
14
5
24
25
1
23
27
9

RADIAL BLOWER WITH RESILIENTLY MOUNTED BEARING HOLDERS

BACKGROUND OF THE INVENTION

The invention relates to radial blowers with a motor housing and a rotating unit mounted in this housing and consisting of a shaft, a blower rotor and a motor armature, a first rolling bearing being provided between the blower rotor and motor armature and a second rolling bearing in the area of the shaft end remote from the blower rotor, and bearing holders resiliently mounted in the housing being associated with the rolling bearings.

A blower of this kind is disclosed in EU-A No. 235,392, to which U.S. Pat. No. 4,764,086 corresponds. The assembly and disassembly of such a blower is obviously difficult, so that the replacement of worn parts is complicated and requires long interruptions of operation. The balancing process cannot be performed until after the rotating unit has been installed in the housing. The resilient mounting of the bearings in the housing make it difficult to determine the location of imbalances.

It is the object of the present invention to create a blower of the kind described above, in which the assembly, disassembly, and above all the balancing process will be easier to perform with precision.

SUMMARY OF THE INVENTION

The outside diameter of the holder of the first bearing is larger than the outside diameter of the motor armature and holder of the second bearing, and the diameter of the holder of the second bearing is equal to or, preferably, less than the diameter of the motor armature. In a radial blower constructed in this manner, the rotating unit can be removed as a whole from the blower housing after the flow casing has been removed. Any replacement of worn parts that might be necessary in maintenance and repair work is thus especially easy. To minimize the down time it is desirable to replace the rotating unit as a whole. It is an advantage that the rotating unit can be balanced independently of the motor housing, and substantially more accurately. In the installed state, resilient bearing suspensions are necessary, and these make the balancing process difficult. The balancing of a removed rotating unit can be performed without resilient bearing suspension. An additional advantage of the invention is that the bearing holders, especially the disk-like bearing holder associated with the first bearing, permit a more accurate guidance of the bearings in the motor housing due to its relatively large diameter and length.

DESCRIPTION OF THE DRAWING

The sole figure is a side section view of the radial blower.

DETAILED DESCRIPTION OF THE PREFERRED EMBODIMENT

The drawing shows a turboradial blower 1 with a flow casing 2 and a motor housing 3. The flow casing includes the gas inlet 4, the wall 6 defining the flow passage 5, the diffuser 7, and the manifold 8 with the outlets 9. The rotating unit mounted in the motor housing 3 consists of the blower rotor 11, the shaft 12 and the motor armature 13.

Rolling bearings 14 and 15 are provided for mounting the shaft 12, one of them, 14, being disposed between the blower rotor 11 and the motor armature 13, while the second bearing 15 is situated in the area of the free end of shaft 12 remote from the blower rotor 11. Bearing holders 16 and 17 are provided for holding the rolling bearings 14 and 15 in the bearing housing 3. The bearing holder 17 associated with rolling bearing 15 is in the form of a sleeve which is resiliently supported by the O-rings 21 and 22 in the bearing housing 3. In the sleeve-like bearing holder 17 the outer ring of rolling bearing 15 is supported on a helical spring 23, so that thermal elongation of the shaft 12 will be possible. The motor and bearing chamber of the motor housing 3 is closed on the blower rotor side with a flange-like cover 24 which is screwed to the motor housing 3 by means of screw fastenings 25 disposed laterally of the blower rotor 11. The motor housing itself is equipped with a flange 26 which in turn is releasably joined to the flow casing 2 by the externally accessible screw fastenings 27.

The outside diameter of the disk-like bearing holder 16 is greater than the diameter of the motor armature 13, and its diameter is in turn greater than the outside diameter of the sleeve-like bearing holder 17. On account of these dimensions it is possible, after separating the flow casing 2 and motor housing 3 and after removing the cover 24, to remove the rotating unit (blower rotor 11, shaft 12, motor armature 13) as a whole from the motor housing 3. The replacement of the rotating unit is thus especially simple. It is important that the rotating unit is able to be balanced completely outside of the bearing housing 3. Nor is it necessary to suspend the rotating unit resiliently in the balancing machine. In the installed state this resilient suspension is essential to permit a completely vibration-free mounting. The clearance between the bearing holders 16, 17 and the housing 3, which is necessary to achieve this resilient suspension, is shown somewhat exaggerated.

We claim:

1. Radial blower (1) with a motor housing (3) and a rotating unit, consisting of a shaft (12), a blower rotor (11) and a motor armature (13), mounted in this housing, a first rolling bearing (14) being provided between the blower rotor (11) and motor armature (13), and a second rolling bearing (15) being provided at the end of the shaft remote from the blower rotor and resiliently mounted bearing holders (16, 17) being associated with the respective rolling bearings (14, 15) in the bearing housing (3), characterized in that the outside diameter of the bearing holder (16) of the first bearing (14) is greater than the outside diameters of motor armature (13) and bearing holder (17) of the second bearing (15), and that the diameter of the bearing holder (17) of the second bearing (15) is smaller than or equal to the diameter of the motor armature (13).

2. Radial blower in accordance with claim 1, characterized in that the bearing holder (16) of the first bearing (14) is of a disk-like configuration and is supported by the O-ring (18) in the bearing housing (3).

3. Radial blower in accordance with claim 1 or 2, characterized in that the bearing holder (17) of the second bearing (15) of sleeve-like configuration and is supported by two O-rings (21, 22) in the bearing housing (3).

4. Radial blower in accordance with claim 3, characterized in that the outer bearing ring of the bearing (15) is supported in the axial direction by a helical spring in the sleeve-like bearing holder (17).

* * * * *

UNITED STATES PATENT AND TRADEMARK OFFICE

CERTIFICATE OF CORRECTION

PATENT NO. : 4,963,076

DATED : October 16, 1990

INVENTOR(S) : Fleischmann et al.

It is certified that error appears in the above-identified patent and that said Letters Patent is hereby corrected as shown below:

Column 2, line 59, (claim 3) delete "or 2".

Signed and Sealed this

First Day of September, 1992

*Attest:*

DOUGLAS B. COMER

*Attesting Officer*

*Acting Commissioner of Patents and Trademarks*